United States Patent [19]

Hidetsugu

[11] Patent Number: 4,936,292

[45] Date of Patent: Jun. 26, 1990

[54] MASSAGE DEVICE

[76] Inventor: Nishiguchi Hidetsugu, 561, Meiwa-cho oaza uninaka, Taki-gun, Mie 515-03, Japan

[21] Appl. No.: 276,894

[22] Filed: Nov. 28, 1988

[51] Int. Cl.[5] ..... A61H 23/04

[52] U.S. Cl. ..... 128/53; 128/52

[58] Field of Search ..... 128/55, 51, 52, 53

[56] References Cited

U.S. PATENT DOCUMENTS

| | | | |
|---|---|---|---|
| 1,210,809 | 1/1917 | Johansen | 128/52 |
| 1,577,751 | 3/1926 | Paschall | 128/51 |
| 1,910,135 | 5/1933 | Torrence | 128/51 |
| 2,186,105 | 1/1940 | Hall | 128/55 |
| 3,043,293 | 7/1962 | Rider | 128/52 |
| 3,083,709 | 4/1963 | Lengsfeld | 128/52 |
| 3,277,887 | 10/1966 | Thomas | 128/53 |
| 3,461,861 | 8/1969 | Barkalow et al. | 128/53 |
| 3,489,140 | 1/1970 | Mullikin | 128/51 |
| 3,626,933 | 12/1971 | Pollock et al. | 128/52 |
| 3,955,563 | 5/1976 | Maione | 128/53 |
| 4,016,873 | 4/1977 | Anderson | 128/53 |
| 4,412,534 | 11/1983 | Hamabe et al. | 128/52 |
| 4,523,580 | 6/1985 | Tureaud | 128/52 |
| 4,615,336 | 10/1986 | Fijimoto | 128/52 |
| 4,660,548 | 4/1987 | Bacheir | 128/52 |
| 4,721,100 | 1/1988 | Hengl | 128/52 |
| 4,777,945 | 10/1980 | Curtoz et al. | 128/55 |
| 4,807,602 | 2/1989 | Scarborough et al. | 128/52 |

FOREIGN PATENT DOCUMENTS

| | | | |
|---|---|---|---|
| 2050889 | 5/1972 | Fed. Rep. of Germany | 128/52 |
| 3026941 | 2/1982 | Fed. Rep. of Germany | 128/52 |
| 3237696 | 4/1984 | Fed. Rep. of Germany | 128/52 |
| 1535612 | 7/1968 | France | 128/53 |
| 1040753 | 9/1966 | United Kingdom | 128/53 |
| 2120099 | 11/1983 | United Kingdom | 128/52 |

*Primary Examiner*—Edgar S. Burr
*Assistant Examiner*—Tonya Lamb
*Attorney, Agent, or Firm*—Kanesaka & Takeuchi

[57] ABSTRACT

A massage device including a casing with a pair of openings; a pair of foot rests with a sheet covering the opening; a pair of movable units provided within the casing and movable in an X-axis direction; a pneumatic or hydraulic engine with a hydraulic cylinder secured to the movable unit such that it is movable in a Y-axis direction perpendicular to the X-axis direction and has a piston rod with a pressure unit at its free end for applying an intermittent pressure to part of the body through the sheet; a fluid supplying circuit for supplying a fluid to the hydraulic cylinder; and a pressure control device for controlling a maximum pressure of a fluid supplied to the hydraulic cylinder.

6 Claims, 11 Drawing Sheets

MASSAGE DEVICE

BACKGROUND OF THE INVENTION

This invention relates to a massage device which provides pleasant and effective massaging of the soles of the feet.

Recently several different types of massage machines operating according to mechanical and electromagnetic principles which can replace skilled practitioners in Japanese finger acupressure (Shiatsu) therapy have been developed.

Some of these massage devices resemble the so-called shoulder massage machines for massaging the waist, back, shoulders, etc. which use the opening and closing motion of a pair of massage device elements in contact with the appropriate part of the body. Other massage devices use rollers mounted under a bed which move as they press against the appropriate part of the body of a patient sleeping atop the bed. Vibrator devices which convert rotary motion generated by a motor into reciprocating motion to create vibrations or which transmit vibrations generated by electromagnetic methods to the appropriate part of the body to obtain a massage effect are also well known.

Devices for massaging the sole of the foot, which, operating on the same principle as shoulder massage devices, use the opening and closing motion of a pair of massage device elements in contact with the foot, and hand held vibrators for transmitting vibrations to the sole of the foot are also used.

The shoulder massage devices described above have serious drawbacks, however. The opening and closing of the massage device elements produce a massaging effect only at those places on the body which can be reached by this type of device. These massage devices cannot produce the same effect as shiatsu applied by finger pressure at an acupressure point on the body. Moreover, the pressure applied by the massage device elements on the body varies as the massage device elements move across the surface of the body. Thus an even massaging effect cannot be achieved.

Moving rollers pressing against the body likewise cannot achieve the same effect as shiatsu at the acupressure points of the body. The irregular rises and depressions on the surface of the human body do not correspond to the fixed path which the rollers should follow across the body. Thus the rollers cannot apply pressure evenly along the surface of the body and cannot provide an even massaging effect.

Techniques using hand held vibrators naturally cannot produce shiatsu like effects. Obtaining an even pressure as the vibrator moves along appropriate places on the body is very difficult.

SUMMARY OF THE INVENTION

Accordingly, it is an object of the invention to provide a massage device capable of producing an acupressure effect on sensitive points of the body thus providing massaging on raised and depressed parts of the body with even pressure.

According to one embodiment of the invention there is provided a massage device including a fluid supply; a hydraulic cylinder connected to the fluid supply; a piston slidably fitted in the hydraulic cylinder; a pressure member attached to an end of the piston for applying a pressure to part of the body; and pressure control device for controlling a maximum pressure of a fluid from the fluid supply to the hydraulic cylinder. It is preferred that the pressure control device is a pressure reducing pressure control valve capable of controlling the maximum pressure of a fluid supplied to the hydraulic cylinder.

According to another embodiment of the invention there is provided a massage device including a casing with at least one opening on its top wall; at least one foot rest with a sheet covering the opening; at least one hydraulic cylinder with a piston rod having a pressure unit which applies an intermittent pressure part of the body via the sheet; a driving device for moving the hydraulic cylinder in a plane substantially parallel to the sheet; a fluid supplying circuit for supplying a fluid to the hydraulic cylinder; and a pressure control device provided in the fluid supplying circuit for controlling a maximum pressure of the fluid to the hydraulic cylinder.

The casing may be rotatably mounted on a platform and locked at a given angle by means of a locking device.

According to still another embodiment of the invention there is provided a massage device including a casing with at least one opening; at least one foot rest with a sheet covering the opening; a movable unit provided within the casing such that it is movable in an X-axis direction; a hydraulic cylinder which is secured to the movable unit such that it is movable in a Y-axis direction perpendicular to the X-axis direction and has a piston rod with a pressure unit for applying an intermittent pressure to part of the body via the sheet; an X-axis driving device for moving the movable unit in the X-axis direction; a Y-axis driving device for moving the hydraulic cylinder within the movable unit in the Y-axis direction; a carrier stage attached to the movable unit such that it slidably contacts the sheet, the carrier stage having a groove with a predetermined width in which a tip of the hydraulic cylinder passes; a fluid supplying circuit for supplying a fluid to the hydraulic cylinder; and a pressure control device for controlling a maximum pressure of a fluid supplied to the hydraulic cylinder.

With the first embodiment, it is possible to move the hydraulic cylinder on the proper location of the body so that the shiatsu unit intermittently presses the proper location by means of the hydraulic circuit which reciprocates the piston rod. The pressure control device provided in the hydraulic circuit is equipped with a device capable of keeping the maximum pressure applied to the proper body points constant despite the rises and falls of the body contour. The maximum pressure control device may be a reducing pressure, pressure control valve enabling one to set the maximum pressure at a given value.

With the second embodiment, when the feet rest on the foot rests, the shiatsu units intermittently press the soles of the feet at a predetermined period by means of the hydraulic circuit reciprocates the piston rods. The driving devices are then controlled to move the hydraulic cylinders so that the shiatsu units provide the intermittent pressure over the entire soles of the feet. Similarly, the maximum pressure control device in the hydraulic circuit keeps the pressures to the soles by the shiatsu units constant despite the rises and falls of the sole surface.

With the locking device, the casing may be locked to the platform such that its top surface faces upward thereby permitting the user to sit on a chair for receiving the massage. When the casing is locked to the platform such that its top surface becomes substantially parallel to a vertical plane, the user may lie on the back for receiving the massage. When the locking device is released so that the casing is able to rotate freely, the user may move the ankles freely thereby eliminating unnatural load on the ankles.

In the third embodiment, the movable units are movable in the X-axis direction (between the inner and outer sides of a foot) and the hydraulic cylinders are attached to the movable units such that they are movable in the Y-axis direction (between the toe and heel of a foot), whereby the hydraulic cylinders are movable in both the X-axis and Y-axis directions while applying an intermittent pressure to the soles of the feet. When the feet rest on the foot rests, the feet are supported by the top plate through the sheets so that the feet do not fall while the hydraulic cylinders move in the X-axis and Y-axis directions thereby eliminating the need for an effort to keep the feet at the desired height.

Other objects, features, and advantages of the invention will be apparent from the following description when taken in conjunction with the accompanying drawings.

DESCRIPTION OF THE PREFERRED EMBODIMENT

Embodiment of this invention are explained below using the accompanying drawings. First, the application of this invention to a massage machine which massages the sole of the foot is described.

Figure 1:
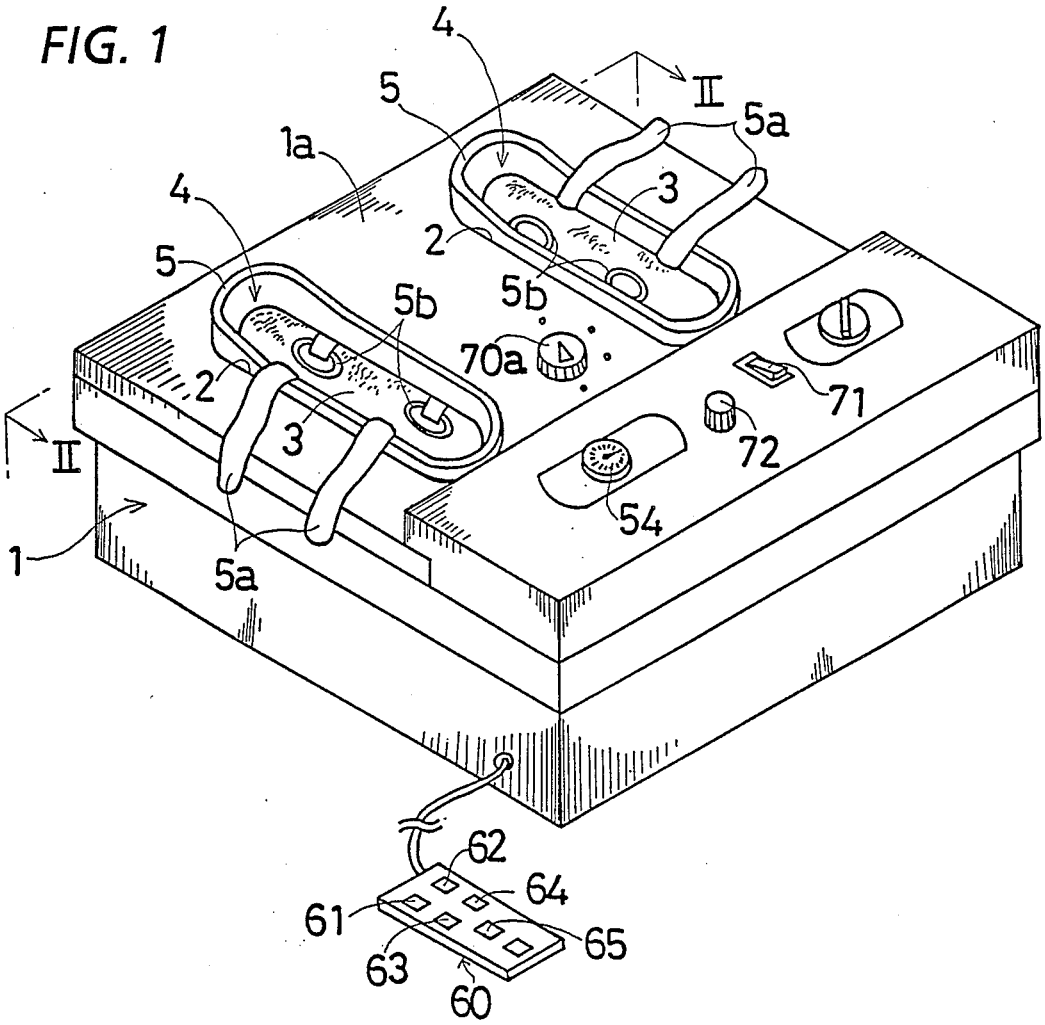
FIG. 1 is a perspective view of a massage device according to an embodiment of the invention.
Figure 6:
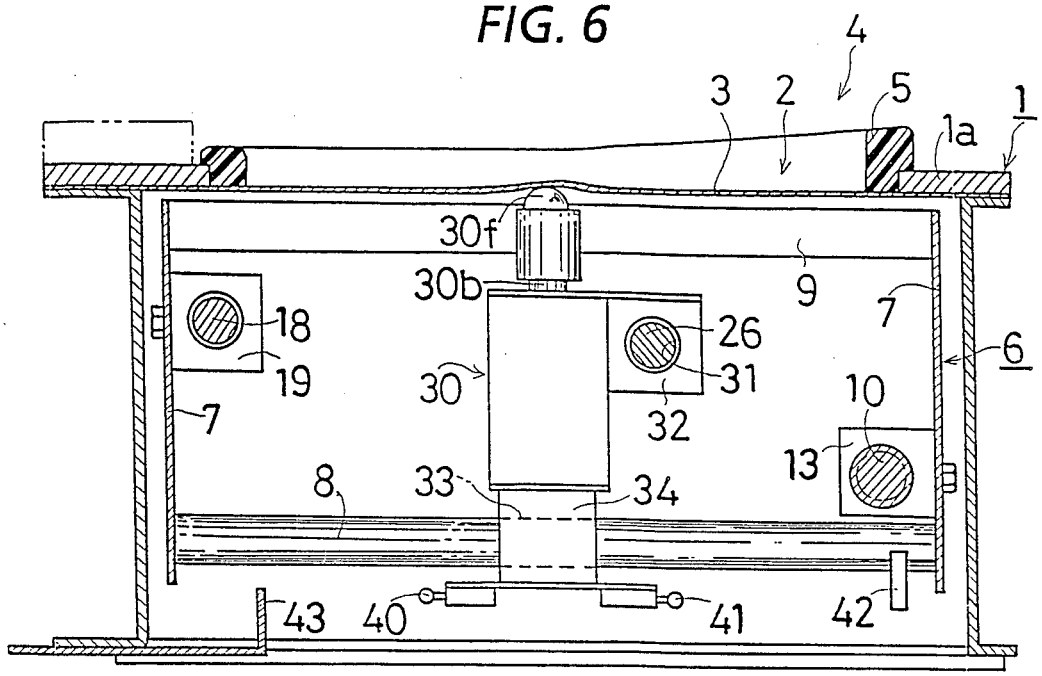
FIG. 6 is a sectional view taken along the line VI—VI of FIG. 3.
Figure 2:
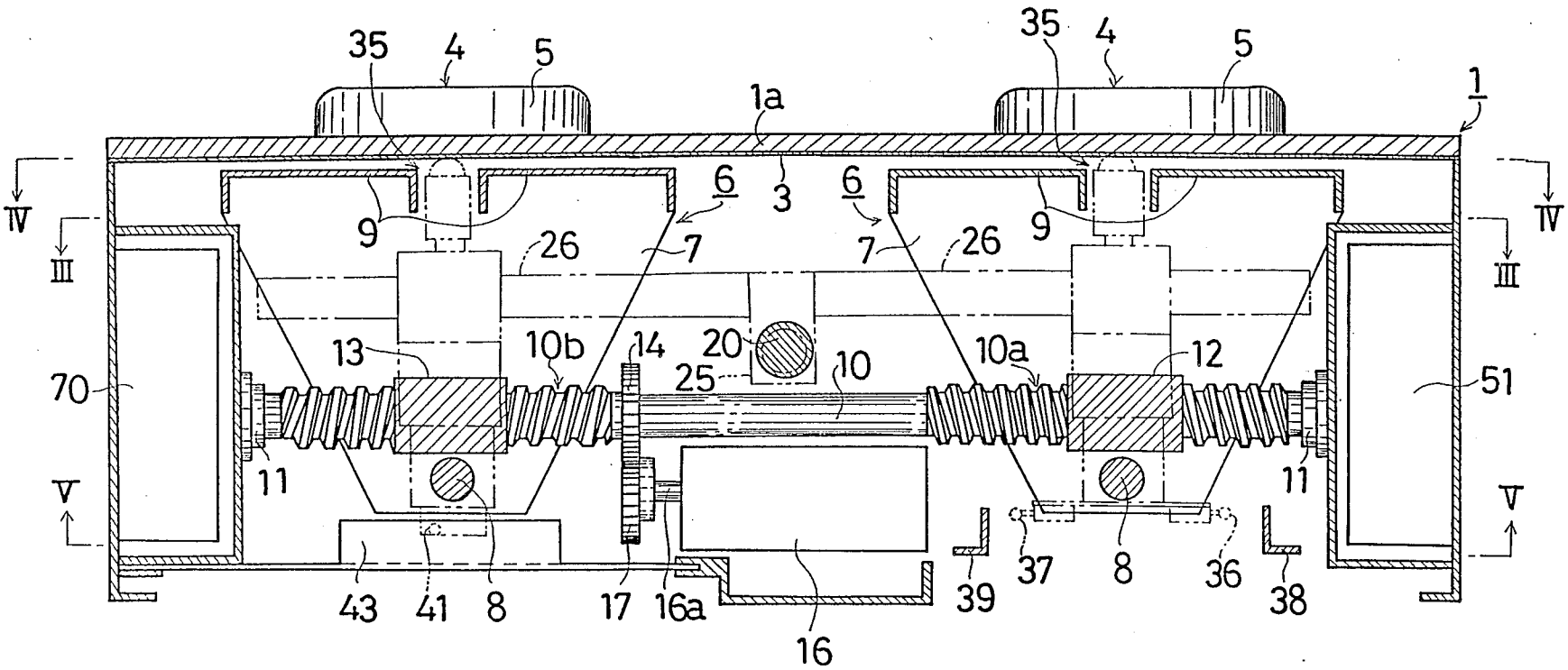
FIG. 2 is a sectional view taken along the line II—II of FIG. 1.
Figure 3:
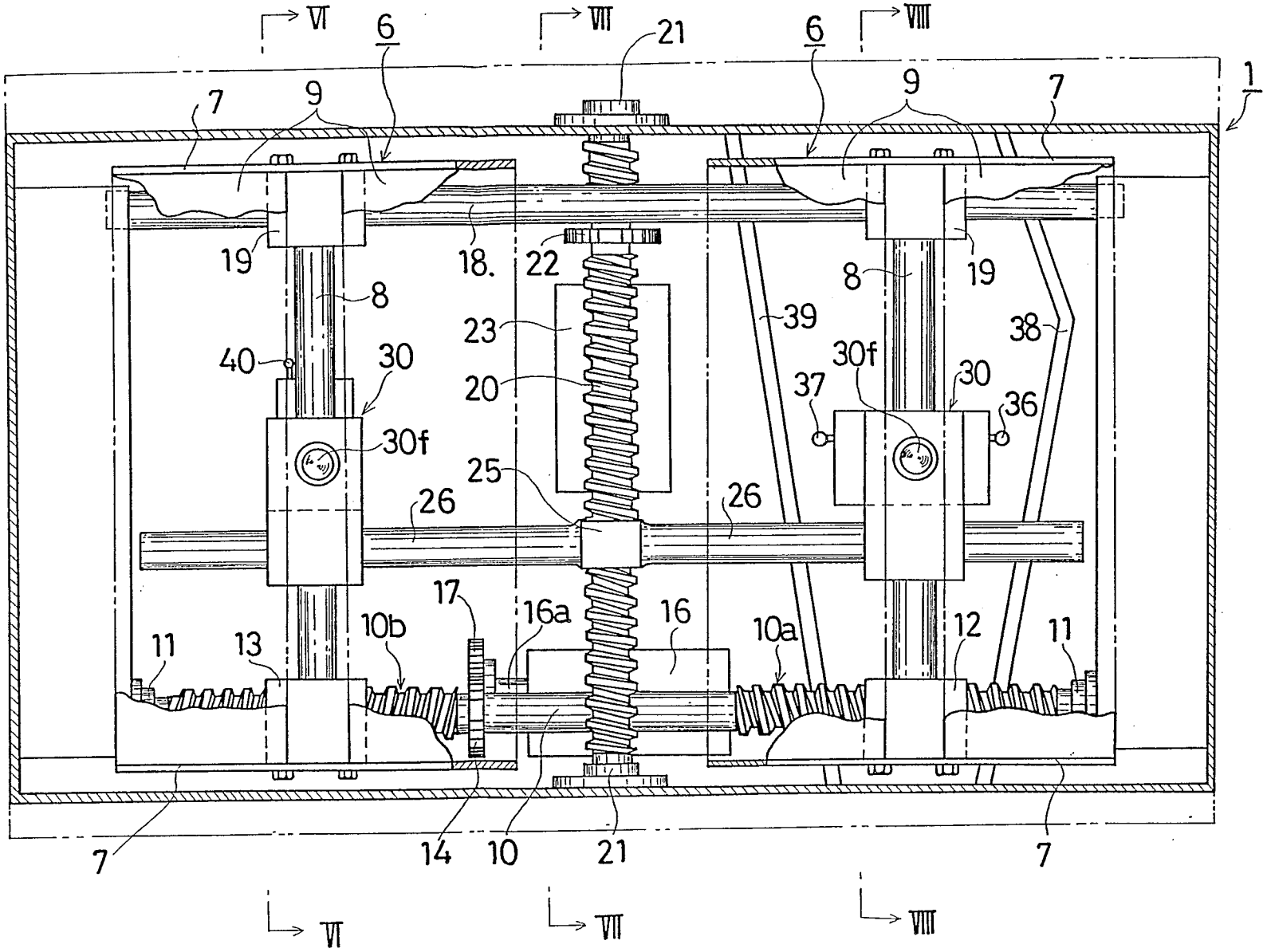
FIG. 3 is a sectional view taken along the line III—III of FIG. 2.
Figure 4:
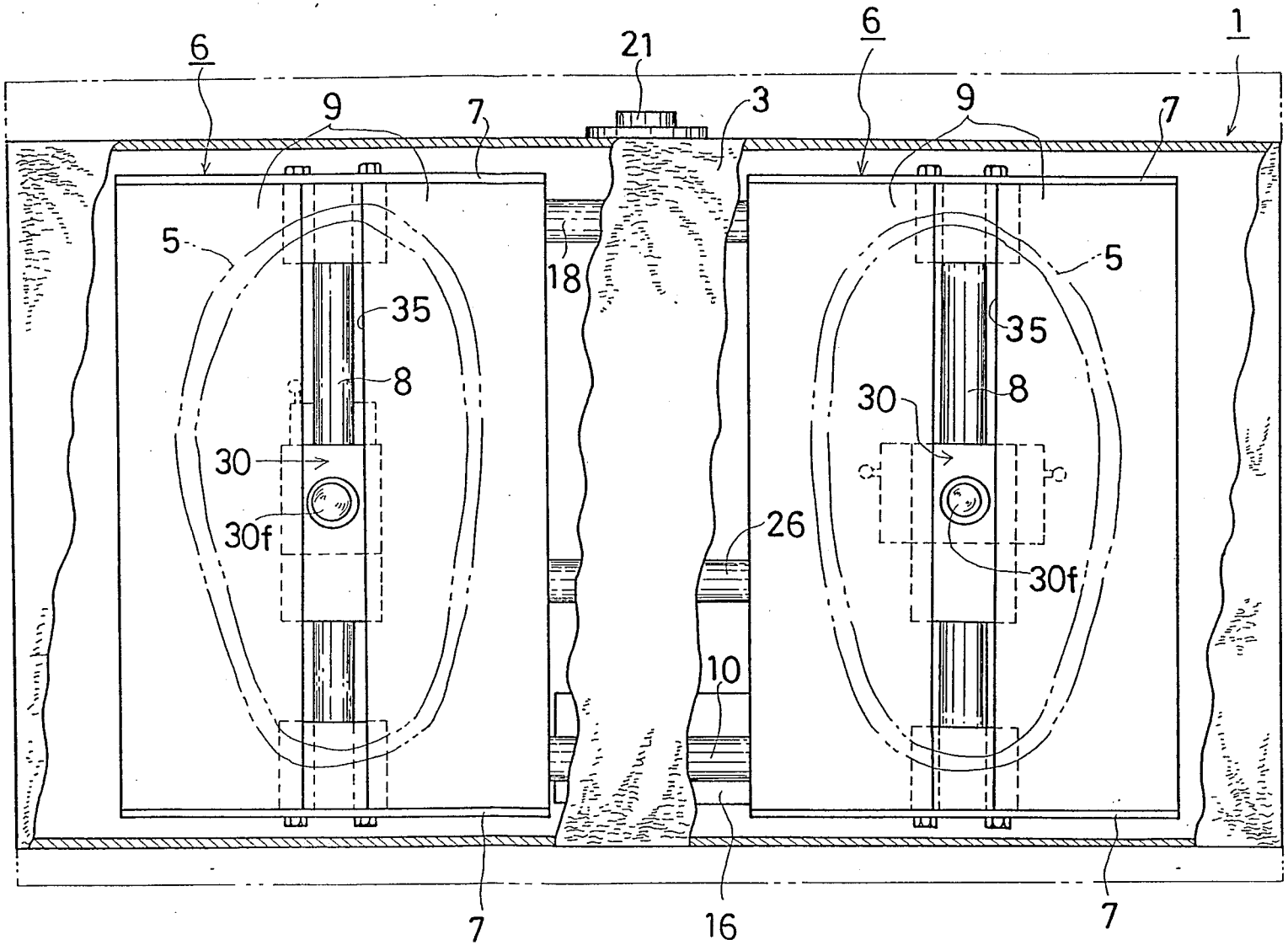
FIG. 4 is a sectional view taken along the line IV—IV of FIG. 2.
Figure 8:
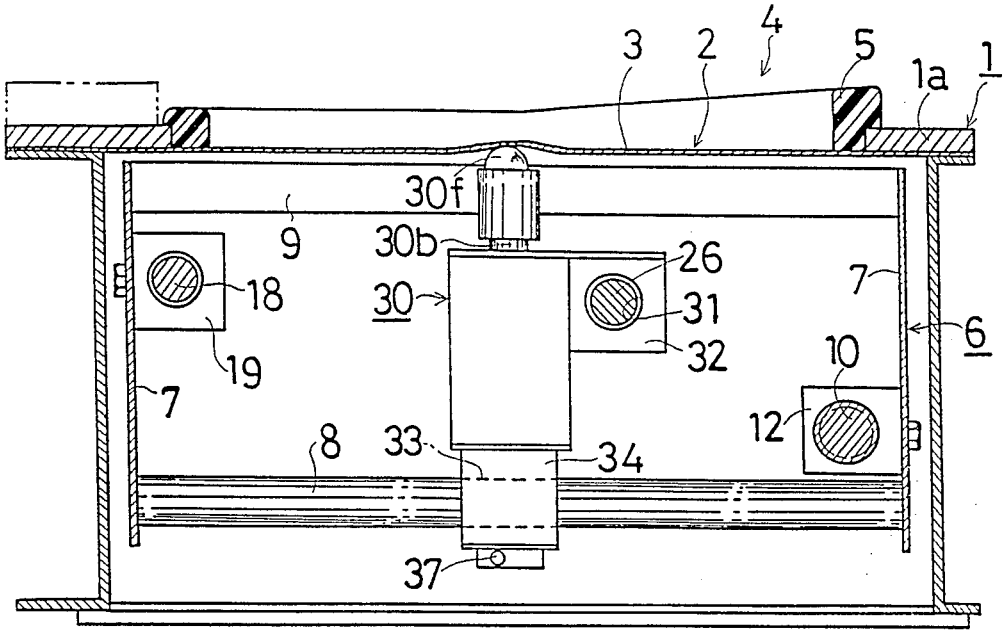
FIG. 8 is a sectional view taken along the line VII—VIII of FIG. 3.

In FIG. 1, a sole massaging machine incorporating this invention includes a pair of foot rests 4,4 made up of parallel openings 2,2 in the top wall 1*a* of a casing 1 and flexible cloth sheet 3,3 which stretches across the bottom of the openings so as to close them (see FIG. 6 and FIG. 8). Plastic protectors 5,5 in the shape of a foot sole are placed along the circumferential edges of the openings 2,2. Belts 5*a*,5*a* and rings 5*b*, 5*b* are provided to fasten the foot securely to the foot rests 4,4.

FIG. 2 through FIG. 5 show a pair of moving units 6,6 inside the casing 1 which move in parallel along the X axis (from the left to right). These moving units 6,6 are placed in positions corresponding to the pair of foot rests 4,4 inside the casing 1. Each of the moving units 6 consists of two side plates 7,7 at the front and back; a guide rod 8 fixed in the Y direction (backwards and forwards direction) and extending across the two plates; and a top plate 9 which extends to the upper ends of the side plates 7,7 and is attached to them. The sheet 3 is in contact with the upper surface of top plate 9 or else there is only a small space between the two. Accordingly, when feet are placed in foot rests 4,4 the soles of the feet are supported by the top plate 9 through the sheet 3.

On one side of the interior of casing 1, a first screw shaft 10 extending along the X-axis is supported by bearings 11 so that it can rotate freely. It has a right-handed screw 10*a* on the right side and a left-handed screw 10*b* on the left side. A right-handed nut 12 is fastened to the plate 7 at the rear of the right moving unit 6. The right-handed nut 12 is screwed on the right-handed screw 10*a* of the first screw shaft 10. A left-handed nut 13 is fastened to the plate 7 at the rear of the left moving unit 6. The left-handed nut 13 is screwed onto the left-handed screw 10*b* of the first screw shaft 10. A gear 14 fastened near the center of the first screw shaft 10 meshes with a gear 17 which is fastened to a drive shaft 16*a* of a first drive motor 16 (see FIG. 2). The first drive motor 16 produces rotary motion according to a preset electric signal, thereby rotating the first screw shaft 10 and moving the pair of moving units 6,6 symmetrically along the X-axis. In this example, the device which produces the drive in the X-direction includes the first drive motor 16, the first screw shaft 10, the right-handed screw nut 12 and the left-handed screw nut 13. Moreover, on the other side of the interior of the casing 1 (the front side) a guide rod 18 extending in the X-direction is attached to the casing 1. A pair of guide blocks 19, which are attached to the side plate 7,7 at the front of the moving unit 6,6, are mounted on the guide rod 18 in such a way that the guide blocks 19 can move freely, sliding on the surface of the guide rod 18, in the X-direction.

Figure 7:
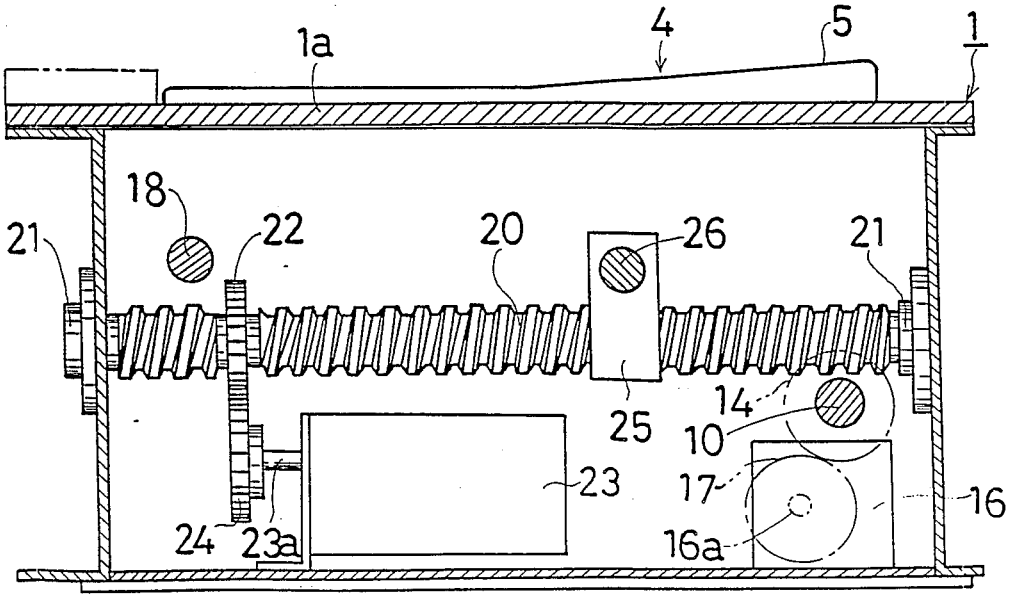
FIG. 7 is a sectional view taken along the line VII—VII of FIG. 3.

In the central area of the casing 1, a second screw shaft 20 extending in the Y-direction is supported by bearings 21, 21 in such a manner that it rotates freely within the casing 1. A gear 22 fastened to the front section of a second screw shaft 20 meshes with a gear 24 fastened to a drive shaft 23*a* of a second drive motor 23 (see FIG. 7). A nut 25 is screwed onto the second screw shaft 20. The nut 25 constitutes as a single unit with two extension rods 26, 26 which extend out of both sides of nut 25 along the X-axis. Thus, in this example the device which produces movement in the Y-axis direction is composed of the second drive motor 23, the second screw shaft 20, the nut 25 and the extension rods 26, 26.

The pair of moving units 6, 6 have pneumatic or hydraulic cylinders 30, 30. Fixed to each of the pair pneumatic cylinders 30, 30 are a slide block 32 which has an X-axis shaft hole 31 and a slide block 34 which has a Y-axis shaft hole 33 (see FIG. 6 and FIG. 8). A pair of the extension rods 26, 26 are inserted in the X-axis shaft holes 31, 31 so that they can move freely in the axial direction. Similarly, the guide rod 8 from each of the moving units 6, 6 is inserted in the Y-axis shaft holes 33, 33 so that they can move in the axial direction. Moreover, in each of the top plates 9, 9 on the moving units 6, 6 a channel 35 extending in the Y-axis direction and having a predetermined width permits the upper end of the air cylinder to pass when the air cylinder 30, 30 moves in the Y-direction along the guide rods 8, 8 (see FIG. 2 and FIG. 4).

Limit switches 36 and 37 area attached to the slide block 34 at the bottom of one side (the right side) of air cylinder 30 so as to detect movements of the air cylinder 30 to the left or to the right. A pair of contact rails 38 and 39 which the limit switches 36 and 37 contact are shaped to follow roughly the inner and outer sides of the foot.

Similarly, limit switches 40 and 41 are attached to the slide block 34 at the bottom of the other side (the left side) of the air cylinder 30 so as to detect movements of the air cylinder 30 to the front or to the back. A pair of contact 42 and 43 which the limit switches 40 and 41 contact are positioned corresponding to the toe and the heel of the foot. Here, the contact 42, in a position corresponding to the back of the foot, is fastened to the guide rod 8. The contact 43 on the other side, corresponding to the tip of the foot, is held in place on the bottom wall of the casing 1 so that it can slide forwards and backwards. By sliding the contact 43 on the other side a suitable distance, the position of the front end of the pneumatic cylinder 30 can be changed according to the size of the foot (see FIG. 5 and FIG. 6).

Figure 9:
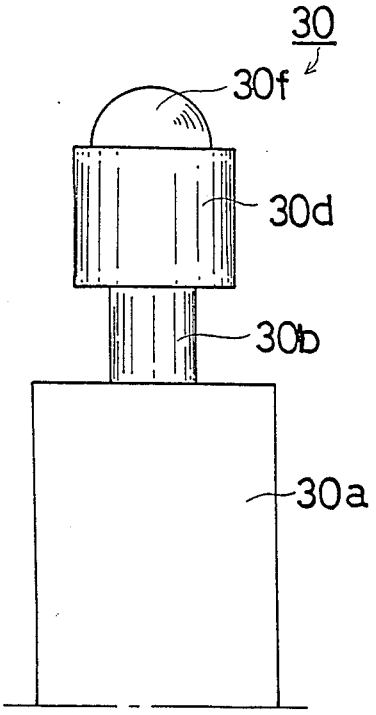
FIG. 9 is an elevational view of a pneumatic cylinder useful for the massage device of FIG. 1.
Figure 10:
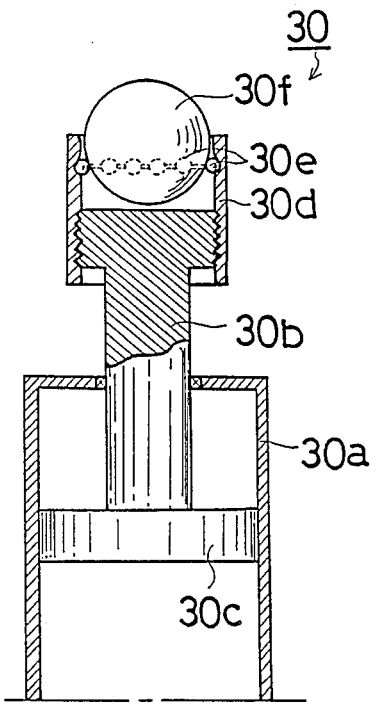
FIG. 10 is a longitudinal section of the pneumatic cylinder of FIG. 9.

Now, the structure of the pneumatic cylinder 30 is described in detail with reference to FIG. 9 and FIG. 10. The air cylinder 30 has an piston rod **30*b* fastened to cylinder section 30*a* in a manner that allows it to move in and out. Selectively supplying or removing the working fluid or air from the upper area or the lower area of the piston 30c produces the up and down movement of the piston rod 30*b*. A removable bearing block 30*d* is screwed to the upper end of the piston rod 30*b*. On the upper end of the bearing block 30*d*, ball bearings 30*e* hold a spherical shiatsu unit 30*f*** so that it can rotate freely.

Figure 11:
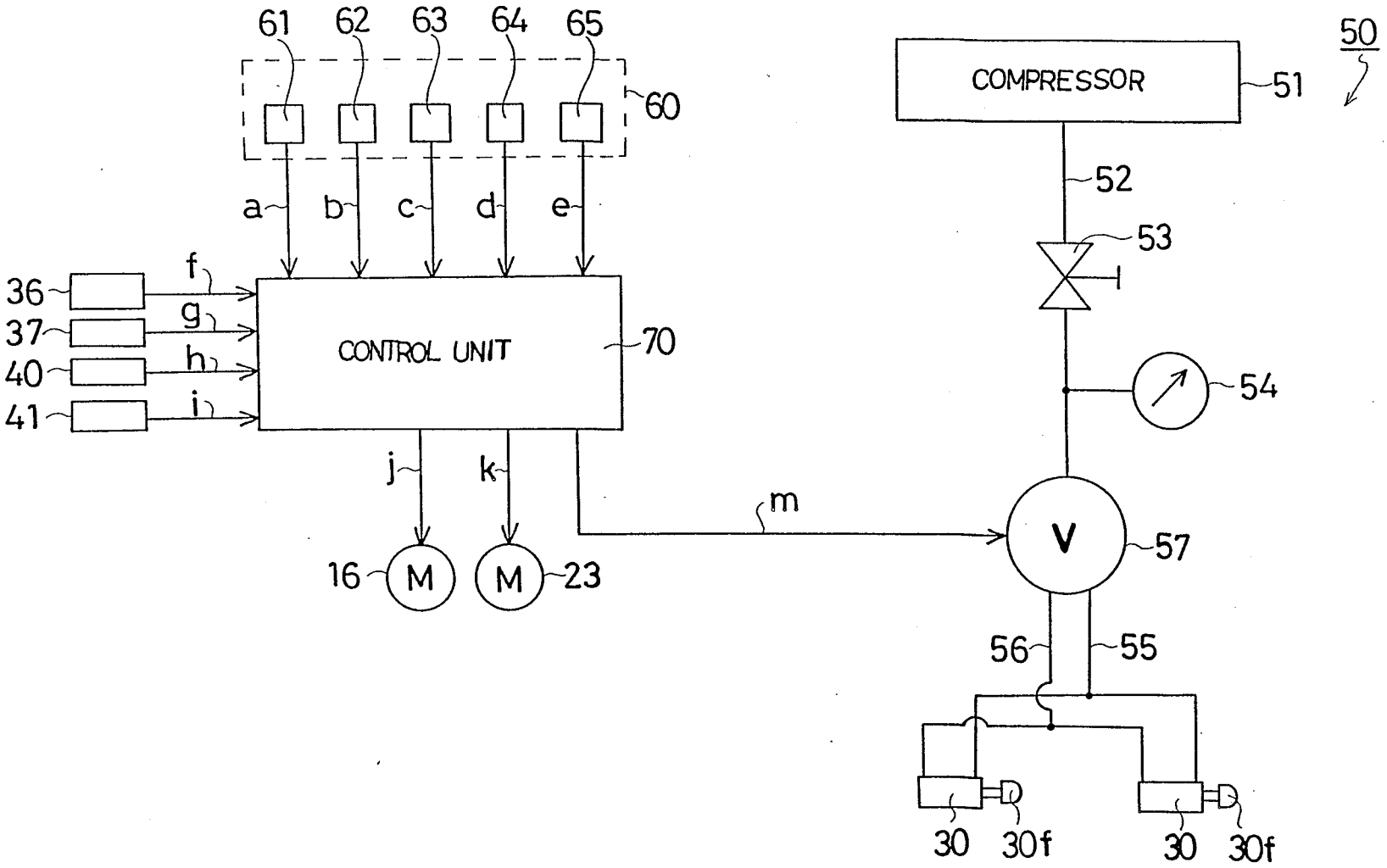
FIG. 11 is a schematic diagram of a pneumatic circuit useful for the massage device of FIG. 1.

The fluid feeding and exhaust circuit 50 for supplying and removing air in pneumatic cylinders 30, 30 shown in FIG. 11 includes a compressor 51 as its power source (continued within casing 1); a fluid pressure adjustment valve 53 for regulating the pressure of the air from the compressor 51 passing through the main pathway 52; a pressure meter 54 which indicates the value of the air pressure which has been adjusted by the fluid pressure adjustment valve 53; an electromagnetic valve 57 which can select one of two air paths 55 or 56 which pass through the upper or the lower space of pistons 30c, 30con the pair of air cylinders 30, 30. The maximum pressure of the air, which produces the maximum pressure against the sole of the foot by the shiatsu unit 30, can be adjusted manually as desired using a relief valve at the fluid pressure adjustment valve 53. Moreover, the electromagnetic pneumatic valve 57 switches periodically (every two seconds, for example) between air circuits 55 and 56 which serve as the air feeding circuit and the air exhaust circuit, respectively, thereby reciprocating the piston rods **30*b*, 30*b* of the pneumatic cylinders 30, 30 at a predetermined period. Moreover, the fluid pressure adjustment valve 53 can be used as a pressure control valve which maintains the pressure from pressure control device constant at the maximum shiatsu pressure as well as a valve for adjusting the maximum pressure of the shiatsu unit 30*f*** on the sole of the foot as desired.

As shown in FIG. 1, this device includes a control panel 60 having a manually operated forward motion limit switch 61, backward motion limit switch 62, inward motion limit switch 63 and outward motion limit switch 64 and a preset limit switch 65 and a control unit 70 (inside the casing 1) which outputs control signals j and k to the first drive motor 16 and the second drive motor 23 in response to input signals a–e from the switches 61–65 of the control panel 60 and signals f–i from the limit switches 36, 37, 40, 41. The electromagnetic control valve 57 is designed to operate in response to a signal m from the control unit 70.

Figure 12:
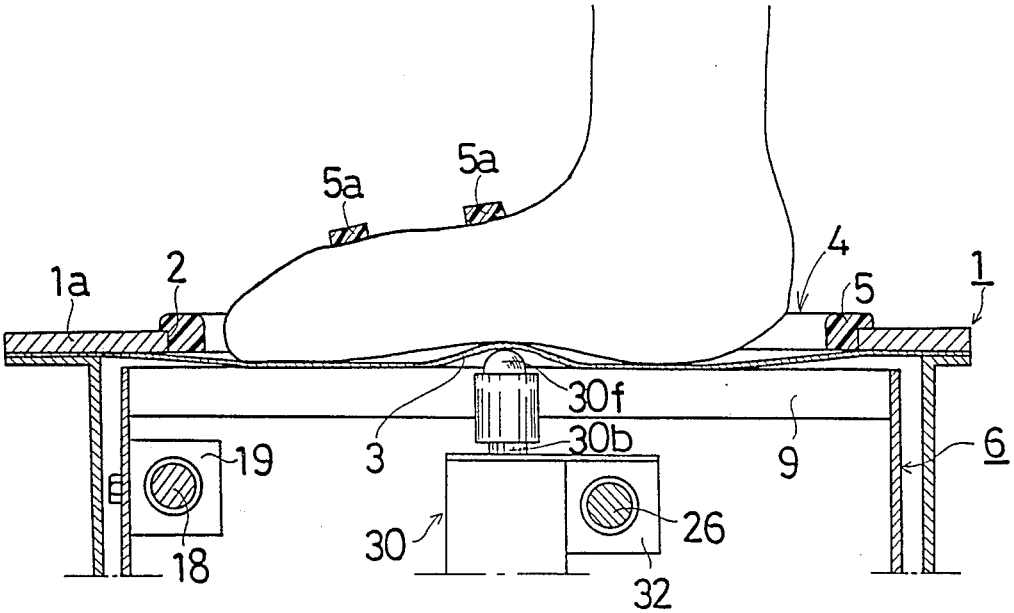
FIG. 12 is a sectional view showing the operation of the massage device of FIG. 1.

The operation of this embodiment is explained. First, the user, in a sitting position, places his feet on the pair of foot rests 4, 4 and then, as shown in FIG. 12, straps his feet in place using belts **5*a*, 5*a*. As FIG. 1 shows, by turning a knob 70*a*, the sliding contact unit 43 (see FIG. 5 and FIG. 6) linked to the knob are moved into positions depending upon the size of the foot. In this situation, by turning the main switch 71 to ON, the compressor 51 is activated to blow air through the main circuit 52. A signal m is sent from the control unit 70 to the electromagnetic valve 57, causing the piston rods 30*b*, 30*b* of the pair of pneumatic cylinders 30, 30 to move in and out periodically. Thus, each shiatsu unit 30*f* connected to the piston rod 30*b* intermittently presses the sole of the foot through the sheet 3 as shown in the FIG. 12. Here, the user adjusts for the maximum pressure that the shiatsu unit 30*f* exerts on the sole of his feet by moving the knob 72 while watching a pressure meter 54 shown in FIG. 1 so as to change the air pressure adjustment made in the fluid pressure adjustment valve 53**.

Figure 5:
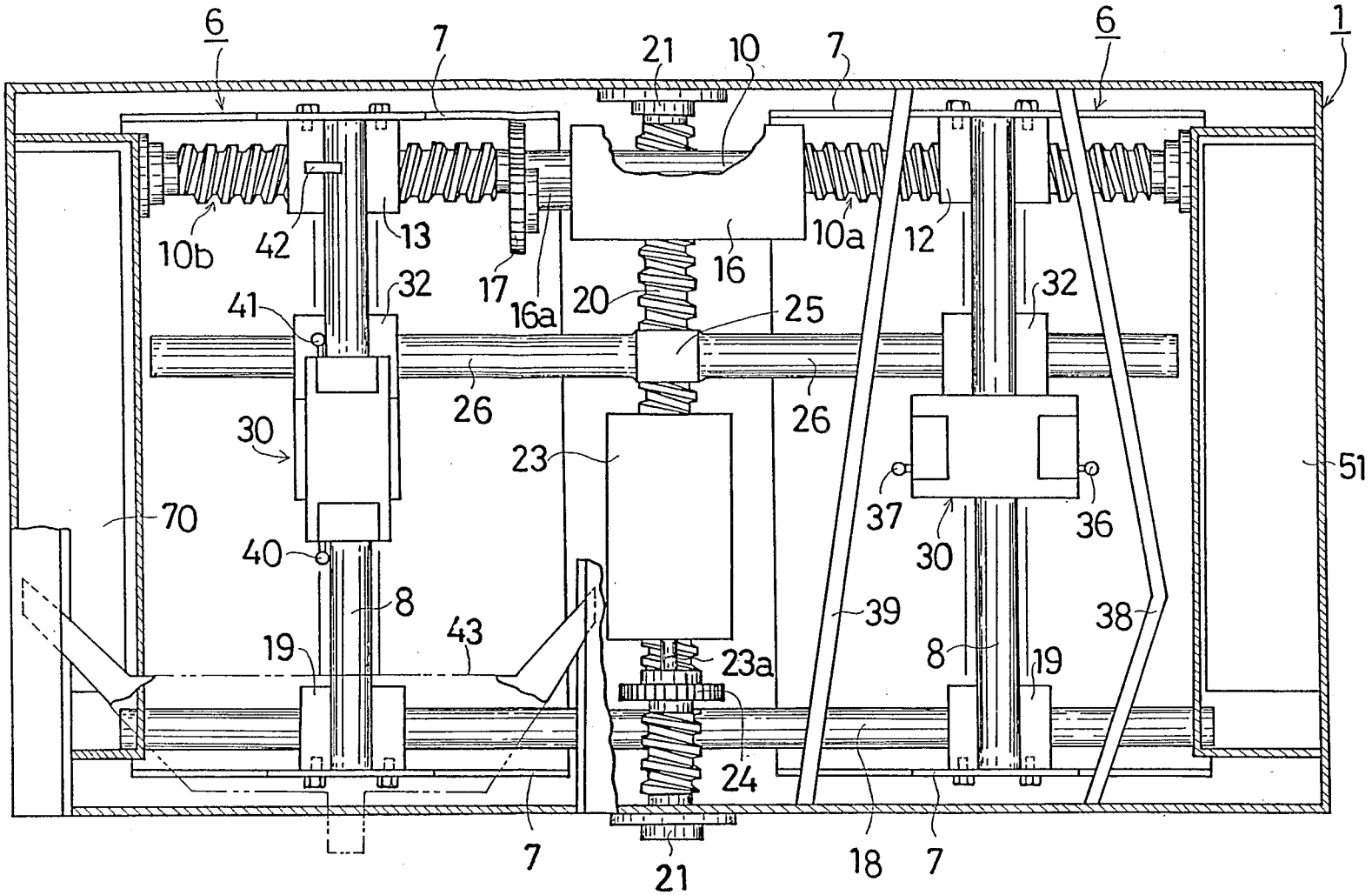
FIG. 5 is a sectional view taken along the line V—V of FIG. 2.

The control unit 70 sends the signal k to the second drive motor 23 to turn the second drive motor 23 clockwise or counterclockwise, which turns the second screw shaft 20 clockwise or counterclockwise, and moves the nut 25 and the extension rod 26, 26 forwards or backwards. This moves the pair of pneumatic cylinders 30, 30 backwards or forwards along the guide rods 8, 8. In this case, the second drive motor 23 switches between clockwise and counterclockwise rotation when a signal h or signal i is ON at limit switches 40 or 41 on the left hand side of pneumatic cylinder 30 as shown in FIG. 5. Accordingly, if the two pneumatic cylinders 30, 30 moves forward, pushing the limit switch 40 into the contact member 43, then the direction of the two pneumatic cylinders 30, 30 changes to backwards. Similarly, if the two pneumatic cylinders 30, 30 moves backwards, pushing the limit switch 41 into the contact member 42, then the direction of the two pneumatic cylinders 30, 30 changes to forwards. If while these operations are being carried repetitively, the user turns the forward motion switch 61 or the reverse motion switch 62 on the control panel 60 to ON, then the input signals a or b to the control unit 70 are ON. This ON signal has priority. If, for example, while the pneumatic cylinders 30, 30 are moving backwards, the signal a from the forward motion switch 61 turns ON, then the pneumatic cylinders 30, 30 will move forward until the signal a turns OFF. Conversely, if while the pneumatic cylinders 30, 30 are moving forward the signal b from the reverse motion switch 62 turns ON, the pneumatic cylinders 30, 30 will move backwards until the signal b turns OFF.

Moreover, if while the pneumatic cylinders 30, 30 are moving back and forth, the user turns the inner movement switch 63 or the other movement switch 64 on the control panel 60 to ON, then a signal c or d input to the control unit 70 will turn ON, the pneumatic cylinders 30, 30 will moves inward in the direction of approach or outward in the direction of separation. The control unit 70, if the signal c from the inner motion limit switch 63 is ON, sends a preset signal j to the first drive motor 16. This signal j makes the first drive motor 16 turn clockwise, which makes the first screw shaft 10 also turn clockwise. This moves the pairs of moving units 6, 6 and of pneumatic cylinders 30, 30 move towards one another. If the signal d from the outward motion switch is ON, the control unit 70 outputs a signal j which makes the first drive motor 16 turn counterclockwise, which makes the first screw shaft 10 also turn counterclockwise. This makes the pairs of moving units 6, 6 and the pneumatic cylinders 30, 30 move away from each other.

If, while the pneumatic cylinders 30, 30 are moving inward or outward, the signal f or g from the limit switches 36 or 37 attached to the right side of the pneumatic cylinder 30 as shown in FIG. 5 turns ON because the limit switch 36 is touching the contact 38 or the limit switch 37 is touching the contact 39, then the control unit 70 sends a signal j for a short interval. This makes the first drive motor 16 reverse its previous direction of rotation so that the remote switch 36 or 37 is temporarily separated from contacts 38 and 39. Accordingly, since the contacts 38 and 39 are made to conform with the inner and outer sides of the foot, the pneumatic cylinder 30 does not deviate from the contours of the foot.

If when the user turns the preset switch 65 on the control panel 60 to ON, the input signal e to the control unit 70 is ON, the control 70 outputs a signal k which makes the direction of rotation of the second drive motor 23 reverse itself at a preset interval (six seconds for example). In this case, the pneumatic cylinders 30, 30 are restricted to back and forth within a narrow range. This enables the shiatsu unit 3*f* to apply pressure specifically to the acupressure points.

The pneumatic or air cylinder 30 used as the fluid cylinder may, of course, be replaced by a hydraulic or oil cylinder.

FIGS. 13–16 show other embodiments of this invention. The casing 1 of the automatic massaging device described above is supported on a platform 82 through a rotary shaft 81 so that the platform 82 can rotate freely. A locking device 83 on one side of the platform 82 makes it possible to fix the casing 1 at a given angle. The locking device 83 includes a disk 84 fixed to one end of the rotary shaft 81 for rotation as a unit with the casing 1; a pair of pads 85, 85 which press on both side of the disk 84; and a lever 85, connected to the pair of pads 85, 85 by a linkage mechanism not shown in the figure, which presses the pads 85, 85 against a disk 84 or separates the pads 85, 85 from the disk 84. Thus, by operating lever 86, the pair of pads 85, 85 are pressed against the disk 84 and the casing 1 is firmly fixed to the platform 82.

Figure 13:
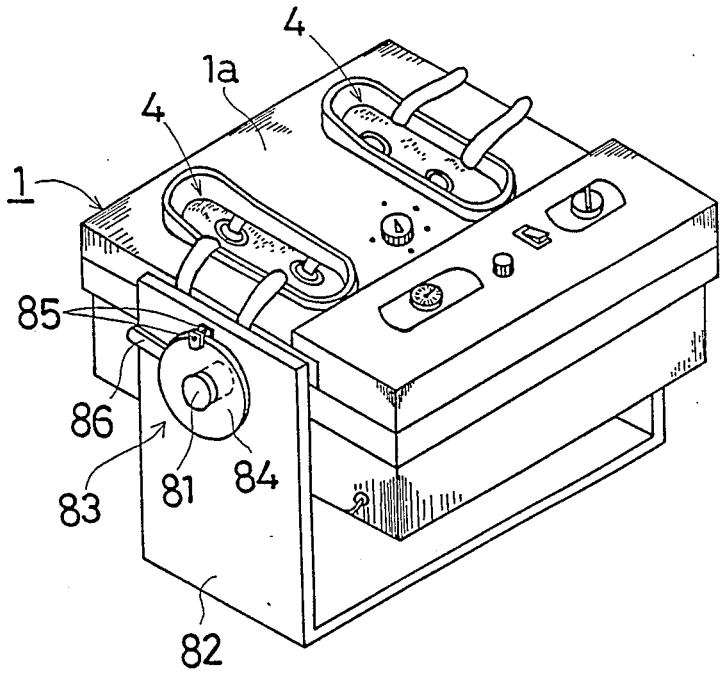
FIGS. 13 and 14 are perspective views of a massage device according to another embodiment of the invention.
Figure 15:
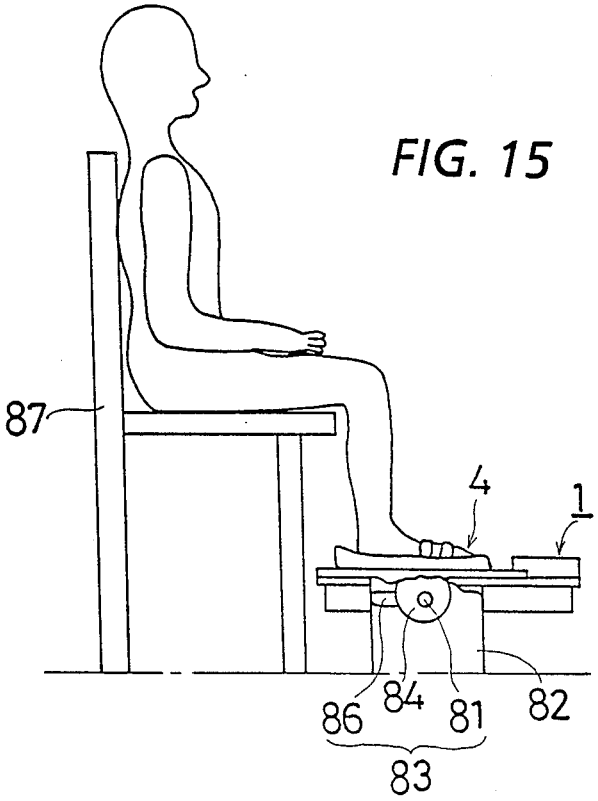
FIGS. 15 and 16 illustrate the operation of the massage device of FIGS. 13 and 14.
Figure 14:
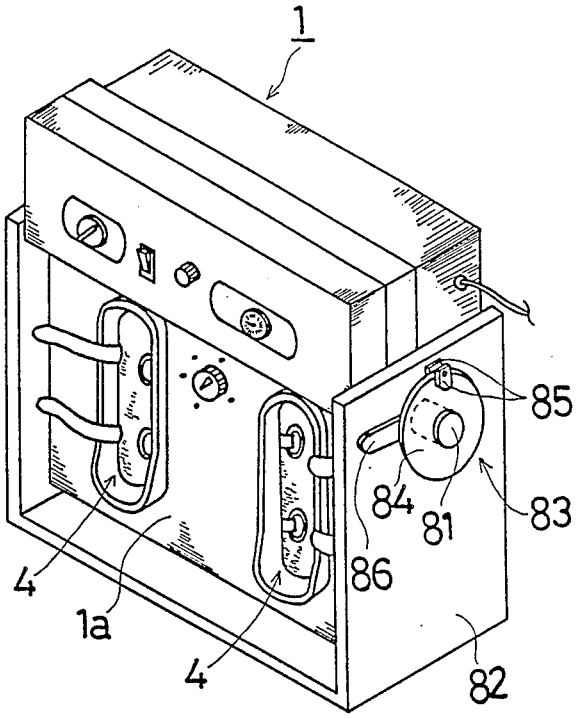
Figure 16:
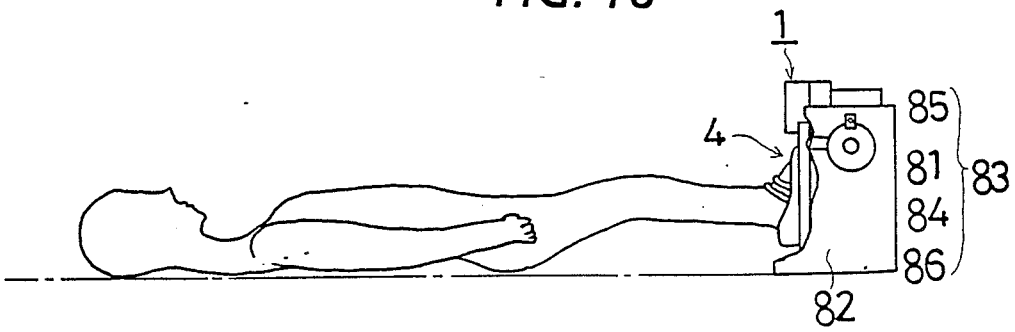
Figure 17:
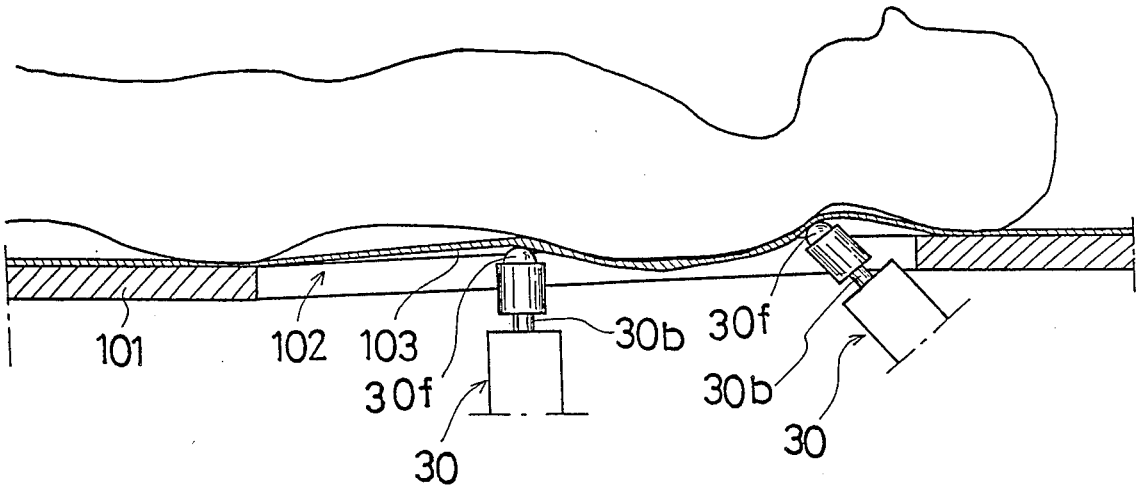
Figure 18:
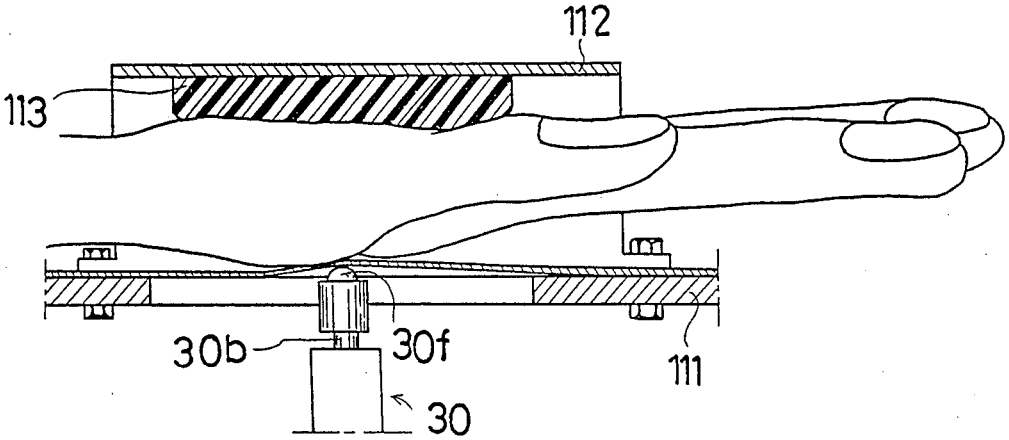

Accordingly, as shown in FIG. 13, if the top wall 1*a* of the casing 1 of the foot rests 4,4 is oriented upwards and the locking device 83 firmly secures the casing 1 in that attitude to the platform 82, then as FIG. 15 shows, the user can use the this massage machine while sitting down. Moreover, if, as shown in FIG. 14, the top wall 1*a* of the casing 1 of the foot rests 4,4 is oriented vertically and the locking device 83 firmly secures the casing 1 in that attitude to the platform 82, then, as FIG. 16 shows, the user can use the massage machine while asleep in a reclining position. Releasing the lock of the lock device 83 enables the casing 1 to rotate with respect to the platform 82. Thus the user can use the massage machine while moving the joints of the hands and feet freely without putting an unnecessary strain on the hands and feet.

Although in this embodiment the invention has been adapted to a machine for massaging the feet, this invention also has other applications in massaging the other acupressure points of the body as well.

While a preferred embodiment of the invention has been described using specific terms, such description is illustrative purposes only, and it is to be understood that changes and variations may be made without departing from the spirit and scope of the invention as recited in the following claims.

What is claimed is:

1. A massage device for a foot, comprising:

a casing with at least one opening;

at least one foot rest with a sheet covering said opening;

a movable unit provided within said casing such that it is movable widthwise of said foot rest;

a fluid-operated engine movable within said movable unit lengthwise of said foot rest, which includes a fluid cylinder; a piston rod slidably fitted in said fluid cylinder; and a pressure unit attached to a free end of said piston rod for applying an intermittent pressure to a sole of said foot through said sheet;

Widthwise driving means for moving said movable unit widthwise of said foot rest;.

Lengthwise driving means for moving said fluid cylinder within said movable unit lengthwise of said foot rest;

a top plate secured to said movable unit, which supports said sole in slidably contacting relation to said sheet and has a channel extending lengthwise of said foot rest in its central portion through which said pressure unit of said fluid-operated engine intermittently passes to apply an intermittent pressure to said sole while said fluid cylinder is moved lengthwise of said foot rest;

a fluid supplying circuit for supplying a fluid to said fluid cylinder; and pressure control means for controlling a maximum pressure of said fluid supplied to said fluid cylinder.

2. The massage device of claim 1, which further comprises:

a platform to which said casing is rotatably attached; and lock means for locking said casing to said platform at a given angle.

3. The massage device of claim 1, wherein the width of said top plate is made greater than that of said foot rest to ensure support of said sole by said top plate even when said movable unit moves to an extremity widthwise of said foot rest.

4. The massage device of claim 1, which further comprises at least one belt for fastening said foot to said foot rest.

5. The massage device of claim 1, wherein said pressure unit comprises:

a bearing block attached to said free end; and a spherical pressure applying member rotatably mounted in said bearing block via ball bearings.

6. A massage device for feet, comprising:

a casing with a pair of openings;

a pair of foot rests with a sheet covering said opening;

a pair of movable units each provided within said casing such that they are symmetrically movable widthwise of said foot rest;

a pair of fluid-operated engine each movable within said movable unit lengthwise of said foot rest, said fluid-operated engines each including a fluid cylinder; a piston rod slidably fitted in said fluid cylinder; and a pressure unit attached to a free end of said piston rod for applying an intermittent pressure to a sole of said foot through said sheet;

Widthwise driving means for moving said movable units symmetrically widthwise of said foot rest;

Lengthwise driving means for moving said fluid cylinders within said movable units lengthwise of said foot rest;

a pair of top plates secured to said movable units, each supporting said sole in slidably contacting relation to said sheet and having a channel extending lengthwise of said foot rest in its central portion through which said pressure unit of said fluid-operated engine intermittently passes to apply an intermittent pressure to said sole while said fluid cylinder is moved lengthwise of said foot rest;

a fluid supplying circuit for supplying a fluid to said fluid cylinders; and pressure control means for controlling a maximum pressure of said fluid supplied to said fluid cylinders.

* * * * *